US012485474B2

(12) United States Patent
Mashiko et al.

(10) Patent No.: US 12,485,474 B2
(45) Date of Patent: Dec. 2, 2025

(54) STRUCTURE FOR MANUFACTURING CAST ARTICLE

(71) Applicant: Kao Corporation, Tokyo (JP)

(72) Inventors: Yuki Mashiko, Moka (JP); Yoshiyuki Kibe, Utsunomiya (JP); Shohei Natsui, Utsunomiya (JP); Toshihiko Mori, Utsunomiya (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 18/035,528

(22) PCT Filed: Oct. 4, 2021

(86) PCT No.: PCT/JP2021/036601
§ 371 (c)(1),
(2) Date: May 5, 2023

(87) PCT Pub. No.: WO2022/097403
PCT Pub. Date: May 12, 2022

(65) Prior Publication Data

US 2023/0405666 A1 Dec. 21, 2023

(30) Foreign Application Priority Data

Nov. 9, 2020 (JP) ..... 2020-186382

(51) Int. Cl.
*B22C 1/04* (2006.01)
*B22C 1/02* (2006.01)
*B22C 1/18* (2006.01)
*B22C 9/08* (2006.01)

(52) U.S. Cl.
CPC ..... *B22C 1/04* (2013.01); *B22C 1/02* (2013.01); *B22C 1/181* (2013.01); *B22C 9/082* (2013.01)

(58) Field of Classification Search
None
See application file for complete search history.

(56) References Cited

U.S. PATENT DOCUMENTS 4,605,057 A * 8/1986 Sakai ..... B22C 1/183 164/520
2008/0105401 A1* 5/2008 Nakai ..... B22C 1/226 164/369
2012/0148736 A1* 6/2012 Bhattacharja ..... B22C 9/04 523/148
2013/0105103 A1* 5/2013 Ikenaga ..... B22C 9/02 164/520
2020/0306821 A1 10/2020 Takama et al.
2020/0306822 A1 10/2020 Takama et al.
2020/0346279 A1 11/2020 Shiiba et al.

FOREIGN PATENT DOCUMENTS

CN 106747522 A 5/2017
CN 106903300 A 6/2017
CN 107671231 A 2/2018
CN 111117144 A 5/2020
EP 3715010 A1 * 9/2020 ..... B22C 1/00
JP 2007-144511 A 6/2007
JP 2010142857 A * 7/2010
JP 2019-093448 A 6/2019

OTHER PUBLICATIONS

Machine translation JP-2010142857-A (Year: 2024).*
Extended European search report issued on Aug. 9, 2024, in corresponding European patent Application No. 21888956.6, 8 pages.
International Search Report and Written Opinion mailed on Dec. 7, 2021, received for PCT Application PCT/JP2021/036601, filed on Oct. 4, 2021, 9 pages including English Translation.

* cited by examiner

*Primary Examiner* — Alexandre F Ferre
(74) *Attorney, Agent, or Firm* — XSENSUS LLP

(57) ABSTRACT

A structure for manufacturing a cast article includes an organic component, at least a portion thereof being an organic fiber. The structure has a mass reduction rate of 1 mass % or greater to less than 20 mass % when heated under nitrogen atmosphere at 1000° C. for 30 minutes. The cast-article-manufacturing structure includes an inorganic particle. The cast-article-manufacturing structure includes, as the inorganic particle, a first inorganic particle having a predetermined shape and/or physical property, and a second inorganic particle having a predetermined shape and/or physical property different from the first inorganic particle. In addition thereto or instead thereof, the cast-article-manufacturing structure has a maximum bending stress of 9 MPa or greater measured in conformity with JIS K7017, and a bending strain of 0.6% or greater at the maximum bending stress.

19 Claims, No Drawings

STRUCTURE FOR MANUFACTURING CAST ARTICLE

CROSS-REFERENCE TO RELATED APPLICATION(S)

The present application is a 371 of International Application No. PCT/JP2021/036601, filed Oct. 4, 2021, which claims priority to Japanese Application No. JP 2020-186382, filed Nov. 9, 2020, wherein the entire contents and disclosure of the foregoing applications is incorporated herein by reference.

TECHNICAL FIELD

The present invention relates to a structure for manufacturing a cast article.

BACKGROUND ART

Typically, a wood mold, a metal mold, or a sand mold is used as a casting mold for manufacturing cast articles. Improvement in shapeability and shape retainability, weight reduction, and disposal cost reduction are demanded of such casting molds. Applicant has previously proposed a structure for manufacturing a cast article, including an inorganic fiber, a layered clay mineral, and an inorganic particle other than the layered clay mineral, the structure having an organic content equal to or less than a predetermined amount (Patent Literature 1).

CITATION LIST

Patent Literature

Patent Literature 1: US 2020/346279 A1

SUMMARY OF INVENTION

The present invention relates to a structure for manufacturing a cast article.

In an embodiment, the structure includes an organic component.

In an embodiment, at least a portion of the organic component of the structure is an organic fiber.

In an embodiment, the structure has a mass reduction rate of 1 mass % or greater to less than 20 mass % when heated under nitrogen atmosphere at 1000° C. for 30 minutes.

In an embodiment, the structure includes an inorganic particle.

In an embodiment, the structure includes, as the inorganic particle, a first inorganic particle which is not a layered particle, and a second inorganic particle which is a layered particle.

In an embodiment, the structure includes, as the inorganic particle, a first inorganic particle having a melting point of 1200° C. or higher, and a second inorganic particle having a melting point below 1200° C.

In an embodiment, the structure has a maximum bending stress of 9 MPa or greater measured in conformity with JIS K7017.

In an embodiment, the structure has a bending strain of 0.6% or greater at the maximum bending stress measured in conformity with JIS K7017.

DESCRIPTION OF EMBODIMENTS

The structure disclosed in Patent Literature 1 has excellent shapeability and shape retainability, but still has room for improvement in terms of improving handleability regarding e.g. processing/assembling of the structure at the time of manufacturing the casting mold, reducing gas defects in cast articles due to combustion gas originating from organic materials contained in the structure at the time of casting, and also reducing burn-on occurring on the cast article's surface.

The present invention relates to a structure for manufacturing a cast article, capable of improving handleability, reducing gas defects, and also reducing burn-on occurring on the cast article's surface.

The present invention will be described below according to preferred embodiments thereof.

The structure for manufacturing a cast article (also referred to hereinafter simply as "structure") of the present invention can be suitably used as a segment die or casting mold used for casting.

In the present Description, "structure for manufacturing a cast article (cast-article-manufacturing structure)" or "structure" may refer either to a member, such as a segment die, constituting a portion of a casting mold, or a casting mold itself, depending on the context.

In the present Description, "mass %" refers to the percentage in terms of mass with respect to the entire mass of the cast-article-manufacturing structure, unless specifically stated otherwise.

For the sake of explanation, the following describes a cast-article-manufacturing structure which is per se the constituent member of a casting mold having no coating etc. (described below). It should be noted that, in cases where the structure includes a plurality of constituent members or is formed by a plurality of layered structures, the following description applies to an arbitrary constituent member or layered structure.

The structure preferably includes an organic fiber as an organic component. An "organic fiber" is a fibrous matter constituted by an organic component. An organic fiber is more flexible compared to later-described inorganic fibers. Hence, the organic fiber has a function of improving the structure's toughness by entanglement between the fibers and/or bonding with other materials that may be included in the structure.

Preferably, the organic fiber is present at least on the surface of the structure in a dispersed manner, and is more preferably present on the surface and interior of the structure in a dispersed manner.

The dispersed presence of the organic fiber on the surface of the structure can form a network of fibers on the structure's surface. Thereby, the strength and toughness of the structure are drastically improved, compared to structures of conventional art. And unintended fracture and breakage of the structure caused by impact, bending, cracking, etc. are prevented. Thus, in cases of cutting and processing the structure into a desired length, it is possible to suppress fracture of the structure, e.g., suppress the occurrence and progress of cracking, and it is also possible to improve handleability, e.g., suppress breakage at the time of processing/assembling of the structure.

In the present Description, "organic component" refers to a natural substance or a compound containing a hydrocarbon atomic group in its molecular structure. Hence, materials including only carbon element, such as carbon fiber, or constituted by carbon and nitrogen do not constitute an "organic component" or a "material including an organic component" in the present disclosure. Carbon fiber is classified as an inorganic component (described below).

Whether or not the structure includes an organic component can be determined based on the presence/absence of peaks corresponding to C=C bonds, C—H bonds, C=O bonds, and O—H bonds found through solid-state NMR. Among these bonds, if at least a C—H bond or a C=O bond is present, it is determined that the material being measured includes an organic component.

Whether or not the structure includes an organic fiber can be determined by observing the surface and interior of the structure by FT-IR microscopy and a microscope (Model No. VHX-500 from Keyence Corporation; the same applies to all other microscopes mentioned in the present Description), in addition to determination through the aforementioned solid-state NMR. More specifically, FT-IR microscopy is employed to identify the positions where functional groups ascribable to organic matter are mapped, and if organic fibers are observed with a microscope at those positions, it is determined that the structure includes organic fiber.

From the viewpoint of facilitating the formation of a network of organic fibers, it is preferable that the total content of the organic component, including the organic fiber, in the structure is preferably greater than 5 mass %, more preferably 5.5 mass % or greater, even more preferably 6 mass % or greater.

From the same viewpoint, the content of the organic fiber in the structure is preferably 0.3 mass % or greater, more preferably 0.5 mass % or greater, even more preferably 1 mass % or greater.

From the viewpoint of reducing the amount of gas produced at the time of casting, it is preferable that the total content of the organic component, including the organic fiber, is preferably less than 20 mass %, more preferably less than 15 mass %, even more preferably less than 13 mass %. Within this range, gas that flows into the intended cast product can be reduced, thereby improving the quality of the cast article. It is also possible to suppress disadvantages involving burn-on, wherein, for example, molten metal adheres to parts where organic components in the structure have thermally decomposed. Further, when pouring molten metal at the time of casting, it is possible to suppress the produced gas from back-flowing and causing the molten metal to blow back from the end face of a pouring gate, thereby improving safety during casting operation.

From the same viewpoint, it is preferable that the content of the organic fiber in the structure is preferably 10 mass % or less, more preferably 5 mass % or less, even more preferably 2.5 mass % or less.

The content of the organic component in the cast-article-manufacturing structure can be measured according to the following procedure, in cases of performing analysis from the cast-article-manufacturing structure.

As a pretreatment, a sample is obtained by pulverizing and homogeneously mixing a cast-article-manufacturing structure to be measured and subjecting the sample to FT-IR analysis. Then, the intensities of the detected peaks ascribable to C=C bonds are compared, to quantify the content of inorganic components constituted only by carbon, such as carbon fiber, included in the structure. Then, the sample is heated under nitrogen atmosphere at a temperature of 1300° C. or higher, to carbonize the organic component and also measure the mass reduction amount. Next, the carbonized sample is subjected to FT-IR analysis, to quantify the content of the remaining carbon components. Finally, the sum total of the mass reduction amount and a value found by subtracting the content of the carbon component in the carbonized sample from the content of the carbon component in the pre-carbonization sample is calculated, and the sum total is considered as the content of the organic component in the present disclosure.

"Organic fiber" may include, for example, natural fiber, synthetic fiber, regenerated fiber, semisynthetic fiber, recycled fiber, etc. One type of the above may be used singly, or two or more types may be used in combination.

Examples of natural fiber may include pulp fiber, animal fiber, etc.

Examples of pulp fiber may include wood pulp, non-wood pulp, etc.

Examples of wood pulp may include mechanical pulp employing coniferous trees or broadleaf trees as a material, natural cellulose fiber employing coniferous trees or broadleaf trees as a material, etc.

Examples of non-wood pulp may include cotton pulp, linter pulp, hemp, cotton, bamboo, straw, natural cellulose fiber employing these as a material, etc.

Examples of animal fiber may include fiber consisting mainly of protein, such as wool, goat hair, cashmere, feathering, etc.

Examples of synthetic fiber may include fiber including synthetic resin such as polyolefin resin, polyester resin, polyamide resin, poly(meth)acrylic resin, polyvinyl-based resin, polyimide resin, aramid resin, etc. One type of the aforementioned resin may be used singly, or a plurality of types may be used in combination to form a single piece of fiber.

Examples of polyolefin resin may include polyethylene, polypropylene, etc.

Examples of polyester resin may include polyethylene terephthalate, polybutylene terephthalate, polybutylene naphthalate, polyhydroxybutyrate, polyhydroxyalkanoate, polycaprolactone, polybutylene succinate, polylactic acid-based resin, etc.

Examples of polylactic acid-based resin may include polylactic acid, lactic acid-hydroxycarboxylic acid copolymer, etc.

Examples of poly(meth)acrylic resin may include polyacrylic acid, polymethyl methacrylate, polyacrylate, polymethacrylic acid, polymethacrylate, etc.

Examples of polyvinyl-based resin may include polyvinyl chloride, polyvinylidene chloride, vinyl acetate resin, vinylidene chloride resin, polyvinyl alcohol, polyvinyl acetal, polyvinyl butyral, polystyrene, etc.

Examples of regenerated fiber may include cupra, rayon, etc.

Examples of semisynthetic fiber may include acetate fiber, etc.

Examples of recycled fiber may include pulp fiber etc. obtained by cutting and defibrating fibers of waste paper, clothes, etc.

Among the above, from the viewpoint of improving the toughness of the structure and handleability, and also facilitating reduction of defects on the structure's surface at the time of structure manufacturing and casting, it is preferable to use, as the organic fiber, one or plural selected from pulp fiber, fiber including polyester resin, and fiber including aramid resin.

From the viewpoint of improving handleability while improving the shapeability of the structure, it is preferable that the structure further includes another organic component other than the organic fiber.

Examples of materials including such other organic components may include starch, thermosetting resins, coloring agents, thermally expanding particles, etc. One type of the above may be used singly, or two or more types may be used in combination.

From the viewpoint of suppressing combustion of the structure at the time of casting and also improving shape retainability of the structure, it is preferable to use a thermosetting resin.

Examples of thermosetting resin may include phenolic resin, modified phenolic resin, epoxy resin, melamine resin, furan resin, etc.

Examples of phenolic resin may include novolac-type resin, resol-type resin, etc.

Examples of modified phenolic resin may include resin wherein phenol is modified by urea, melamine, epoxy, etc.

One type of the above may be used singly, or two or more types may be used in combination.

Among the above, from the viewpoint of reducing gas production at the time of casting and thereby making it easier to obtain cast articles having excellent dimensional stability and surface smoothness, it is preferable to use phenolic resin as another organic component.

It is preferable that the structure further includes an inorganic component, and more preferably, further includes, as the inorganic component, an inorganic particle. By including an inorganic component in the structure, it is possible to improve heat resistance of the structure and thereby improve the strength, dimensional stability and shape retainability of the structure at the time of casting.

In cases of including inorganic particles in the structure, it is preferable that the inorganic particles are present at least on the surface of the structure, and more preferably, present on both the surface and interior of the structure.

In cases of including inorganic particles, it is preferable that the inorganic particles have a melting point of preferably 1200° C. or higher, more preferably 1500° C. or higher. By using inorganic particles having such a melting point, the structure can have excellent shape retainability even in high temperature conditions at the time of casting.

Realistically, the melting point of the inorganic particles is 2500° C. or lower.

When the melting point of the inorganic particles is within the aforementioned range, it is possible to suppress the cast-article-manufacturing structure from melting significantly at the time of casting, and suppress gas defects and burn-on from occurring in cast articles.

The melting point of the inorganic particles is measured according to the following method. Using a thermogravimetry-differential thermal analysis and mass spectrometry device (TG-DTA/MS) from Nippon Steel Technology Co., Ltd., the melting point is measured by raising the temperature of the cast-article-manufacturing structure under nitrogen atmosphere from 30° C. to 1500° C. at a rate of 20° C./minute, and then after 30 minutes, lowering the temperature to 30° C. at a rate of 20° C./minute. From the measurement result, the melting point of the inorganic component contained in the cast-article-manufacturing structure is determined.

It is preferable that the structure includes one or two or more types of compounds selected from oxides, carbides, and nitrides of an element selected from elements including aluminum, zirconium, silicon, and iron. That is, it is preferable that the structure includes one or two or more types of compounds selected from aluminum oxide, silicon dioxide, iron (II) oxide, iron (III) oxide, aluminum nitride, zirconia, silicon nitride, and silicon carbide.

By including the aforementioned compound in the structure, the heat resistance of the structure is improved even in high temperature conditions at the time of casting, and the structure will have excellent shape retainability.

Inclusion of the aforementioned compound in the structure substantially means that the structure includes inorganic particles.

Inclusion of the aforementioned compound in the structure can be determined by X-ray diffraction measurement. Specifically, the presence/absence and type of compound can be determined by subjecting the measurement-target structure to measurement in the following conditions: tube voltage: 30 KV; tube current: 15 mA; goniometer scan angle: 5-70°; goniometer scan speed: 10°/minute.

In addition to the inorganic particles which may have the aforementioned melting point, a clay mineral may be included. Typically, a clay mineral has a melting point of below 1 200° C.

By further using such clay mineral having the aforementioned melting point, when molten metal is poured in, the clay mineral will melt and fill in the space between the aforementioned inorganic particles, and thereby, the inorganic particles can be prevented from getting separated. As a result, the strength and shape of the structure can be maintained.

The shapes of the inorganic particles may each independently be spherical, polyhedric, scaly, layered, spindle-shaped, fibrous, amorphous, or a combination thereof.

One type of inorganic particle may be used singly, or two or more types may be used in combination.

The following describes an example wherein two types of particles, i.e., a first inorganic particle and a second inorganic particle, are used as inorganic particles that may be included in the structure. The first inorganic particle and the second inorganic particle are different from one another in terms of at least one of predetermined shape and/or physical properties.

In one embodiment, the first inorganic particle is preferably a particle that is not a layered particle (i.e., is a particle having a form other than a layered form). In one embodiment, the second inorganic particle is preferably a layered particle.

In another embodiment, the first inorganic particle has a melting point of preferably 1200° C. or higher. In another embodiment, the second inorganic particle has a melting point of preferably below 1200° C.

In yet another embodiment, the first inorganic particle has a melting point of preferably 1200° C. or higher, and more preferably, is a particle which is not a layered particle. Further, in yet another embodiment, the second inorganic particle has a melting point of preferably below 1200° C., and more preferably, is a layered particle. As described above, by providing one type of particle with a plurality of physical properties and using a plurality of types of inorganic particles having different physical properties from one another, it is possible to improve the strength and handleability of the structure.

The following description is applicable, as appropriate, to respective descriptions regarding the foregoing embodiments, unless specifically stated otherwise.

As regards the first inorganic particles, from the viewpoint of further improving the heat resistance of the structure, it is preferable to use, as the first inorganic particles, one or two or more types selected from graphite, mullite, obsidian, zirconium, silica, fly ash, and alumina, and more preferably, use at least graphite and mullite. Mullite includes aluminum oxide, silicon dioxide, and iron oxide.

In general, graphite can be classified into naturally occurring products such as scaly graphite, earthy graphite, etc., and artificial graphite manufactured artificially by using petroleum coke, carbon black, pitch, etc., as a material. Among such graphite, from the viewpoint of improving shapeability of the structure, it is preferable to use scaly graphite.

From the viewpoint of improving air permeability of the structure and suppressing gas defects in cast articles, it is preferable that the average particle size of the first inorganic particles is preferably 1 μm or greater, more preferably 10 μm or greater.

From the viewpoint of allowing the structure to maintain sufficient hot strength even at the time of casting, it is preferable that the average particle size of the first inorganic particles is preferably 1000 μm or less, more preferably 500 μm or less.

To make the average particle size of the inorganic particles fall within the aforementioned range, it is possible, for example, to sieve the inorganic particles being used as the material, or subject the inorganic particles to further pulverization, such as dry pulverization, wet pulverization, etc., using a known pulverizer.

The average particle size of the first inorganic particles can be found by measuring the particle size distribution using, for example, a laser diffraction/scattering-method particle size distribution measurement device (LA-950V2 from Horiba, Ltd.). A dry unit is used as an accessory for measuring the particle size distribution, and the particle size in a powdery state is measured, wherein the inorganic particles are dispersed by compressed air. As for the measurement conditions, the compressed air pressure is set to 0.20 MPa and the flow rate is set to 320 L/minute, and measurement can be performed by adjusting the amount of sample introduced such that the laser absorbance is from 95% to 99%. From the obtained volume-based particle size distribution, the median value of the particle size is calculated, which is defined as the average particle size.

In cases where a second inorganic particle is included as the inorganic particle, it is preferable that the second inorganic particle is a layered clay mineral. Stated differently, it is preferable that the structure includes, as the second inorganic particle, a layered particle, and more preferably includes a layered particle of clay mineral.

A layered clay mineral can achieve a thickening effect by taking in water and swelling, thereby allowing the various materials of the structure to be uniformly mixed easily at the time of manufacturing the structure. Further, when dried, the layered clay mineral loses the water molecules present between the unit crystal layers, and thereby, the inorganic particles and the organic fiber solidify while forming a packed structure. As a result, it is possible to improve the strength of the structure at atmospheric temperature and also improve handleability, and furthermore, it is possible to effectively impart hot strength at the time of manufacturing cast articles. In addition, the structure's processability and shape retainability can be maintained, the surface smoothness of the manufactured cast article can be improved, and the rate of occurrence of gas defects can be reduced.

From the viewpoint of achieving a structure having both heat resistance and strength and also having excellent handleability, dimensional stability, and shape retainability at the time of structure manufacturing, handling, and casting using the structure, it is preferable to use, as the inorganic particles, spherical particles and layered particles in combination. More specifically, as the inorganic particles, it is preferable to use, in combination: first inorganic particles, e.g., spherical particles, which are not layered particles; and particles of layered clay mineral as second inorganic particles which are layered particles.

Inclusion of spherical particles and layered particles in the structure can be determined by observing the surface of the structure with a scanning electron microscope (SEM) to observe the shapes of the particles.

The layered clay mineral that may be used as the second inorganic particles mainly has functions of imparting shapeability to the structure and also improving strength at atmospheric temperature and hot strength, which are achieved as a result of the layered clay mineral being interposed between the organic fibers and other materials.

For the layered clay mineral, it is possible to use a crystalline inorganic compound having a layered structure, typified by layered silicate minerals. The layered clay mineral may be natural occurring, or may be artificially manufactured.

Concrete examples of layered clay minerals may include clay minerals typified by kaolinite group, smectite group, and mica group minerals. One type of layered clay mineral may be used singly, or two or more types may be used in combination.

An example of a kaolinite group clay mineral may include kaolinite. Examples of smectite group clay minerals may include montmorillonite, bentonite, saponite, hectorite, beidellite, stevensite, nontronite, etc.

Examples of mica group clay minerals may include vermiculite, halloysite, tetrasilicic mica, etc.

Other than the above, it is possible to use a layered double hydroxide, such as hydrotalcite etc.

Among the aforementioned layered clay minerals, montmorillonite and/or bentonite may suitably be used from the viewpoint of having strong binding force with various components in a water-containing state and also achieving shape impartability during shaping at the time of manufacturing the structure.

Further, from the viewpoint of heat resistance at the time of casting, kaolinite and/or montmorillonite may suitably be used.

From the viewpoint of improving air permeability of the structure and suppressing gas defects in cast articles, it is preferable that the average particle size of the second inorganic particles is preferably 0.1 μm or greater, more preferably 1 μm or greater.

From the viewpoint of improving the structure's strength, shapeability, and shape retainability, it is preferable that the average particle size of the second inorganic particles is preferably 500 μm or less, more preferably 200 μm or less.

In cases of using a layered clay mineral as the second inorganic particles, the average particle size of the layered clay mineral may be within the aforementioned range.

The average particle size of the second inorganic particles can be measured according to the same method as the aforementioned method for measuring the average particle size of the first inorganic particles.

The mass reduction rate of the structure is within a predetermined range in high-temperature environments such as during casting. The mass reduction rate of the structure is correlated with the gas production rate, which is the amount of gas produced due to organic components in the structure at the time of casting. More specifically, the lower the mass reduction rate, the lower the gas production rate tends to become.

Therefore, a lower mass reduction rate means that the hot strength of the structure can be maintained more stably, and also that it is possible to maintain good dimensional precision of the manufactured cast article, reduce gas defects wherein gas produced during casting gets mixed into the cast product, and also reduce burn-on of the structure onto the cast article's surface.

When the structure is heated under nitrogen atmosphere at 1000° C. for 30 minutes, the mass reduction rate is preferably less than 20%, more preferably less than 15 mass %, even more preferably less than 9 mass %. When the mass reduction rate is within this range, it is possible to reduce the amount of gas produced when high-temperature molten metal is poured in at the time of casting. Thus, the amount of gas flowing into the cast product is reduced. And, the quality of the cast article can be further improved. It is also possible to suppress disadvantages involving burn-on, wherein, for example, molten metal adheres to parts where the organic components in the structure have thermally decomposed. Further, when pouring molten metal at the time of casting, it is possible to suppress gas from back-flowing and causing the molten metal to blow back from the end face of a pouring gate, thereby improving safety during casting operation.

The more preferable it is, the less a mass reduction rate is from the viewpoint of efficiently achieving reduction in gas production rate. However, from the viewpoint of sufficiently preventing the structure from disruption, which is achieved by improvement of the structure's toughness thanks to the organic fibers, it is preferable that the mass reduction rate is preferably 1 mass % or greater, more preferably 3 mass % or greater, even more preferably greater than 5 mass %.

To achieve the aforementioned mass reduction rate, it is possible, for example, to set the contents of the organic components, including the organic fibers, and/or the inorganic particles within the aforementioned preferred ranges, or to conduct a heat treatment after performing shaping in the structure manufacturing step to eliminate gas-producing components.

The mass reduction rate is found as follows. Using a thermogravimetric instrument (STA7200RV TG/DTA from Seiko Instruments Inc.), the cast-article-manufacturing structure to be measured is heated under nitrogen atmosphere from 30° C. to 1000° C. at a temperature-rise rate of 20° C./minute, and the structure is kept at 1000° C. for 30 minutes. With reference to the mass of the structure at 30° C. (as 100%), the change in mass at 1000° C. is measured as a function of temperature, and the mass reduction rate (%) is calculated as the percentage of the mass of the structure at 1000° C. with respect to the mass of the structure at 30° C.

The structure's maximum bending stress, which is measured as an index of the structure's toughness, is preferably 9 MPa or greater, more preferably 12 MPa or greater. By having such a maximum bending stress, the structure will have high toughness, which makes it possible to prevent disruption, fracture and cracking of the structure and improve the handleability, shape retainability and dimensional stability of the structure.

From the viewpoint of improving both the handleability of the structure and handleability at the time of casting in a balanced manner, it is preferable that the maximum bending stress of the structure is preferably 50 MPa or less, more preferably 40 MPa or less, even more preferably 30 MPa or less.

The structure's bending strain at the maximum bending stress (also referred to hereinafter simply as "bending strain"), which is measured as an index of the structure's toughness, is preferably 0.6% or greater, more preferably 0.65% or greater. By having such a bending strain, the structure will have high toughness, which makes it possible to prevent disruption and cracking of the structure and improve the handleability, shape retainability and dimensional stability of the structure.

The greater the structure's bending strain is, the more preferable; realistically, however, the bending strain is preferably 8% or less, more preferably 6% or less, even more preferably 4% or less.

The bending strain and the maximum bending stress of the structure can be measured in conformity with the three-point bending test of JIS K7017 using a measurement device (universal tester AGX-plus from Shimadzu Corporation). At this time, for the measurement sample, a 60-mm-long, 15-mm-wide, 2-mm-thick plate-shaped sample is cut out from the structure for measurement.

The maximum bending stress is a physical property value calculated by dividing the moment (i.e., the product of load and distance) applied to the sample during the three-point bending test by the section modulus of the sample. In cases where the aforementioned plate-shaped sample cannot be cut out due to the size of the structure to be measured, measurement can be performed by cutting out a sample with arbitrary dimensions.

The cast-article-manufacturing structure having the aforementioned configuration includes organic fibers. Hence, the moderate softness and elasticity of the organic fibers can enhance the entanglement and bonding between the organic fibers themselves and between the organic fibers and other materials. Thereby, the structure's toughness is improved. As a result, resistance to brittle fracture is improved. Thereby, in various situations—such as during manufacturing of the structure, during handling such as transportation, processing, assembling, etc., or during high-temperature load in casting—the occurrence of disruption, chipping, cracking and fracture on the surface and interior of the structure can be suppressed, and handleability of the structure can be improved. Furthermore, at the time of casting, it is possible to prevent unintended disruption or rupture of the pouring gate, which is the flow path for pouring molten metal into the casting mold. Particularly, the presence of organic fibers on the surface of the structure causes the organic fibers to get entangled with one another and form a network, thereby serving as a mesh covering the structure. Thus, it is possible to effectively suppress the occurrence of disruption, chipping, cracking and fracture on the surface of the structure.

Even if defects, such as minute cracks or fractures, are unintendedly formed during manufacturing of the structure, during handling such as transportation, processing, assembling, etc., or during casting, the presence of the network of organic fibers can suppress the defects such as cracks from further spreading. Thereby, the structure with high shape retainability is provided.

Furthermore, the inclusion of inorganic particles in the structure provides high heat resistance enabling the structure to endure casting. As for the inorganic particles, a suitable form may be to employ the clay mineral in combination with a material other than the clay mineral. In this way, the structure will, on one hand, have excellent heat resistance and high atmospheric-temperature strength as well as hot strength. While on the other hand, the structure will have excellent handleability thanks to the high toughness due to the organic fibers.

In addition, by controlling the mass reduction rate of the structure to fall within a specific range, it is possible to effectively reduce casting defects, such as gas defects and burn-on of the structure onto the cast article's surface, at the time of casting by employing the structure as a casting mold.

As a result, it is possible to manufacture cast articles having excellent dimensional precision and surface smoothness, and also reduce costs for manufacturing cast articles.

The structure is desired to have improved handleability during processing and assembling of the structure. However, if the structure has poor toughness, defective portions, such as crazing, chipping, fracture, etc., are likely to be formed in the structure at the time of processing, such as when the structure is cut into a predetermined size. If such defective portions are likely to be formed in the structure, then the structure itself may disrupt from the defective portions when the structure is used for casting, or molten metal may leak out from the structure. As a result, such a structure will have poor handleability, and in association therewith, will also have poor casting efficiency.

In this regard, the structure of the present disclosure is configured to have excellent toughness. Thus, the present structure can be used by being easily cut with a cutter etc. to adjust the size thereof, and also, even when cutting is performed, defective portions, such as crazing, chipping, fracture, etc., are less likely to be formed in the structure. Furthermore, even in cases where a plurality of structures are coupled together or a plurality of structures are used to assemble a single casting mold, defective portions, such as crazing, chipping, fracture, etc., are less likely to be formed in each of the structures. As a result, the structure of the present disclosure will have excellent handleability at the time of processing and assembling.

From the viewpoint of improving the toughness of the structure to more effectively suppress the occurrence of disruption, chipping, cracking and breakage on the surface of the structure and thereby improve the handleability at the time of use, it is preferable that the structure has organic fibers on the surface of the structure. And it is preferable that the number of organic fibers per unit area of the structure surface is equal to or greater than a predetermined value.

More specifically, it is preferable that the structure has preferably 50 pieces or more, more preferably 70 pieces or more, even more preferably 100 pieces or more, of the organic fibers present per 100 $mm^2$ on the surface of the structure.

Realistically, the number of organic fibers present per 100 $mm^2$ on the surface of the structure is 300 pieces or fewer.

The number of organic fibers present on the surface of the structure can be found as follows. First, the fibrous matters present on the surface of the structure are determined as to whether they are organic fibers or not according to a method using the aforementioned solid-state NMR, FT-IR microscopy, and a microscope. Then, the surface of the structure including the organic fibers is observed with a microscope or SEM, to obtain fiber observation image data. This image data is observed using image processing software (WinROOF from Mitani Corporation; the same applies to all other image processing software mentioned in the present Description), to calculate the arithmetic mean value of the number of fibers for three or more fields-of-view, wherein one field-of-view has an area of 100 $mm^2$.

As regards the measurement area at the time of measuring the number of organic fibers, an area of 100 $mm^2$ may be observed at once, or the observation may be performed a plurality of times to perform observation in an area worth 100 $mm^2$—e.g., areas of 10 $mm^2$ may be observed 10 times.

From the viewpoint of making it easier for a single fiber to contact a plurality of other fibers or materials to improve entanglement properties between the fibers and/or bonding properties with other materials and further increase the toughness of the structure and improve the handleability of the structure, it is preferable that the average fiber length L1 of the organic fibers present on the surface of the structure is preferably 0.5 mm or greater, even more preferably 1 mm or greater.

From the viewpoint of improving shapeability at the time of manufacturing the structure and also improving dimensional uniformity of the structure at the time of manufacturing and casting, it is preferable that the average fiber length L1 of the organic fibers present on the surface of the structure is preferably 7 mm or less, more preferably 5 mm or less, even more preferably 4 mm or less.

The average fiber length L1 of the organic fibers can be found as follows. Fiber observation image data obtained by observing the surface of the structure with a microscope or SEM is observed using image processing software. The length of each measurement-target fiber is measured from one end to the other end, and the arithmetic mean value of the length measured for 50 pieces of fibers can be found as the average fiber length.

From the viewpoint of increasing the contact area with other fibers or materials by increasing the surface area of the fiber to improve entanglement properties between the fibers and/or bonding properties with other materials and further increase the toughness of the structure and improve the handleability of the structure, it is preferable that the average fiber diameter D1 of the organic fibers present on the surface of the structure is preferably 8 μm or greater, more preferably 10 μm or greater.

From the viewpoint of improving shapeability at the time of manufacturing the structure and also improving dimensional uniformity of the structure at the time of manufacturing and casting, it is preferable that the average fiber diameter D1 of the organic fibers present on the surface of the structure is preferably less than 40 μm, more preferably less than 35 μm, even more preferably 30 μm or less.

The average fiber diameter D1 of the organic fibers can be found as follows. Fiber observation image data obtained by observing the surface of the structure with a microscope or SEM is observed using image processing software, and 50 pieces of fibers are arbitrarily selected as measurement targets. The average fiber diameter is found as the arithmetic mean value obtained by measuring the length orthogonal to the measurement-target fiber's length direction at five points for each piece of fiber.

From the viewpoint of improving entanglement properties between the fibers and/or bonding properties with other materials and further increasing the rigidity and strength of the structure, it is preferable that the ratio, 1000×"Average fiber length L1"/"Average fiber diameter D1", which is the ratio of the average fiber length (unit: mm) to the average fiber diameter (unit: mm) of the organic fibers present on the surface of the structure—i.e., the ratio found by dividing the average fiber length L1 (unit: mm) by a value found by dividing the average fiber diameter D1 (unit: μm) by 1000—is preferably 10 or greater, more preferably 30 or greater, even more preferably 50 or greater, even more preferably 100 or greater.

From the viewpoint of improving shapeability at the time of manufacturing the structure and also improving the dimensional uniformity of the structure at the time of manufacturing and casting, it is preferable that the ratio (1000×"Average fiber length L1"/"Average fiber diameter D1") is preferably 260 or less, even more preferably 230 or less.

Insofar as the effects of the present invention are attained, the cast-article-manufacturing structure may further include an inorganic fiber.

In cases of including inorganic fibers, the inorganic fibers mainly function to maintain the shape of the structure without undergoing combustion at the time of manufacturing and casting.

Examples of usable inorganic fibers may include artificial mineral fibers, ceramic fibers, and natural mineral fibers.

Examples of artificial mineral fibers may include carbon fibers such as PAN-based carbon fibers, pitch-based carbon fibers, etc., and rock wool.

One type of inorganic fiber may be used singly, or two or more types may be used in combination.

Among the above, from the viewpoint of maintaining the structure's shape and strength in high-temperature environments during casting, it is preferable to use carbon fibers.

"Carbon fiber" is a fiber that does not contain a hydrocarbon atomic group in its structure but contains a carbon double bond in its structure. Carbon fiber is typically constituted only by carbon element.

Whether or not the structure includes an inorganic fiber can be determined by the following method.

First, the fibrous matters present on the surface of the structure are subjected to elemental mapping and elemental analysis by conducting scanning electron microscope (SEM) energy dispersive X-ray spectroscopy (EDX) analysis or FT-IR microscopy analysis. Through these analyses, the types of elements contained in the fibrous matters, the types of molecular bonds, and the amounts thereof are analyzed. Through these analyses, in cases where fibrous matters with C=C bonds are observed, and where those fibrous matters do not include both a metal element and an oxygen element simultaneously or where fibrous matters without a C—H bond, C=O bond or O—H bond are observed, it is determined that the fibrous matters are inorganic fibers.

In cases where the structure includes inorganic fibers, from the viewpoint of improving the shapeability and uniformity of the cast-article-manufacturing structure, it is preferable that the average fiber length of the inorganic fibers is preferably 0.5 mm or greater, more preferably 1 mm or greater.

Further, from the viewpoint of improving the shapeability of the structure, it is preferable that the average fiber length of the inorganic fibers is preferably 15 mm or less, more preferably 8 mm or less, even more preferably 5 mm or less.

To find the average fiber length of the inorganic fibers, first, the fibrous matters present on the surface of the structure are subjected to the aforementioned method, to determine and specify the fibrous matters which are inorganic fibers. Then, a two-dimensional image is found by microscopically observing the inorganic fibers at a magnification of 50× with a microscope or SEM. From the image, at least 30 pieces of fibers are arbitrarily selected as measurement targets, and the arithmetic mean value of the length, from one end to the other end, measured for each of those fibers can be found as the average fiber length.

In cases where the structure includes inorganic fibers, from the viewpoint of improving the shapeability and uniformity of the cast-article-manufacturing structure, it is preferable that the average fiber diameter of the inorganic fibers is preferably 5 μm or greater, more preferably 10 μm or greater.

From the viewpoint of improving the shapeability of the structure and also improving the dimensional uniformity of the structure at the time of manufacturing and casting, it is preferable that the average fiber diameter of the inorganic fibers is preferably 30 μm or less, more preferably 20 μm or less, even more preferably 15 μm or less.

To find the average fiber diameter of the inorganic fibers, first, the presence of inorganic fibers is determined according to the aforementioned inorganic fiber determination method. Then, at least 30 pieces of inorganic fibers are arbitrarily selected as measurement targets, and the average fiber diameter is found as the arithmetic mean value obtained by measuring the length orthogonal to the fiber's length direction at five points for each piece of fiber.

In addition to the aforementioned components, the cast-article-manufacturing structure may be coated with a coating in an amount that does not impair the effects of the present invention. In this case, the cast-article-manufacturing structure will include: a base portion having the aforementioned configurations as the structure; and a surface layer formed on the surface of the base portion by application of the coating etc.

The coating is applied for the purpose of preventing burn-on and improving surface smoothness and parting properties.

Examples of usable coatings may include materials widely used in sand mold casting and shell mold casting, such as a coating containing refractory particles as a main material and a thermosetting resin or silicone as an organic component.

It should be noted that the cast-article-manufacturing structure according to the present disclosure has excellent burn-on preventiveness, surface smoothness, and parting properties, even in cases where no coating is applied and thus no surface layer is formed.

A method for manufacturing a cast-article-manufacturing structure will be described below. The present manufacturing method is broadly divided into: a step of preparing a structure precursor by mixing an organic component including an organic fiber, an inorganic component as necessary, such as inorganic particles or an inorganic fiber, and a dispersion medium; and a step of heating and pressing the structure precursor in a pressing mold and thereby solidifying and shaping the structure precursor.

The description below explains, as a preferred embodiment, an example of a method for preparing a structure precursor by mixing an organic component including an organic fiber, and inorganic particles.

First, a structure precursor is prepared by mixing an organic component including an organic fiber, an inorganic component such as inorganic particles, and a dispersion medium (mixing step).

More specifically, a structure precursor is prepared by uniformly mixing an organic fiber and a thermosetting resin as organic components, various inorganic particles, and a dispersion medium.

The structure precursor includes an organic fiber and a thermosetting resin as organic components, various inorganic particles, and a dispersion medium, and is in a dough form.

"Dough" refers to a state having flowability and being easily deformable by external force, but wherein the various organic components, the various inorganic components, and the dispersion medium which have been mixed do not easily separate.

The various organic components, the various inorganic components, and the dispersion medium may be mixed by batch addition, or may be mixed by sequential addition according to an arbitrary order. From the viewpoint of uniform mixing, it is preferable to mix the various organic components and various inorganic particles in advance in a dry state, and then add and mix the dispersion medium.

The structure precursor may be prepared, for example, by manual kneading or by kneading with a known kneading device.

In cases of using a kneading device, it is preferable to use, for example, a universal mixer, a kneader, or a pressurized kneader, suitable for mixing high-viscosity matter such as paste, dough, etc.

In cases of using a kneading device, kneading can be performed, for example, by kneading at 6.1 rpm for 30 minutes using a pressurized kneader (from Nihon Spindle Manufacturing Co., Ltd.).

Examples of the dispersion medium may include a water-based dispersion medium, such as a solvent (e.g., water, ethanol, methanol, etc.), or a mixture thereof.

From the viewpoint of improving the dispersion stability and ease of handleability of the various materials, it is preferable to use water as the dispersion medium.

The amount of dispersion medium, such as water, to be added is preferably from 10 to 70 parts by mass with respect to 100 parts by mass in total of the mixture of solid components including the various organic components and the various inorganic particles.

In cases where a layered clay mineral is included as the inorganic particles, the layered clay mineral is granular or powdery in a dry state, but when mixed with water, the cations intercalated between the unit crystal layers of the layered clay mineral are hydrated, and thus water molecules are intercalated between the layers.

In a wet state, the layered clay mineral swells as a result of the water molecules causing an increase in the distance between the unit crystal layers of the layered clay mineral, and thereby, the layered clay mineral becomes a fluid having viscosity.

The fluid of the layered clay mineral has both flowability and viscosity, and can therefore easily enter into the spaces between other components such as organic fibers and inorganic particles, and can also function as a binder that bonds the components together.

From the viewpoint of improving the shapeability and toughness at the time of manufacturing the structure, improving the handleability of the obtained structure, and reducing defects in the structure, it is preferable that the content of the organic fiber with respect to the entire solid content in the structure precursor is preferably 0.3 mass % or greater, more preferably 0.5 mass % or greater.

When performing casting using the obtained structure, from the viewpoint of reducing gas production at the time of casting and thereby reducing defects in cast articles, it is preferable that the content of the organic fiber is preferably 10 mass % or less, even more preferably 5 mass % or less.

The average fiber length and the average fiber diameter of the employed organic fiber may be within the aforementioned ranges, respectively.

From the viewpoint of improving the shape retainability, surface smoothness and parting properties at the time of manufacturing the structure and also at the time of casting, it is preferable that the content of the first inorganic particle with respect to the solid content in the structure precursor is preferably 40 mass % or greater, more preferably 60 mass % or greater.

From the viewpoint of effectively achieving the toughness of the structure and improving the handleability of the obtained structure, it is preferable that the content of the inorganic particles with respect to the solid content in the structure precursor is preferably 90 mass % or less, more preferably 85 mass % or less.

The average particle size of the employed first inorganic particles may be within the aforementioned range.

In cases where the second inorganic particle is included in the structure, from the viewpoint of improving the shapeability of the cast-article-manufacturing structure, it is preferable that the content of the second inorganic particle with respect to the solid content in the structure precursor is preferably 1 mass % or greater, more preferably 3 mass % or greater, even more preferably 5 mass % or greater.

When performing casting using the obtained structure, from the viewpoint of reducing the amount of gas produced from the structure at the time of casting and thereby reducing the rate of occurrence of gas defects in cast articles, it is preferable that the content of the second inorganic particle with respect to the solid content in the structure precursor is preferably 50 mass % or less, more preferably 30 mass % or less, even more preferably 20 mass % or less.

In cases of using a layered clay mineral as the second inorganic particles, the content of the layered clay mineral may be within the aforementioned range.

The average particle size of the employed second inorganic particles may be within the aforementioned range.

Inorganic fiber does not have to be included in the structure—i.e., the content of inorganic fiber in the structure may be 0 mass %—or inorganic fiber may be included in the structure. In cases where inorganic fiber is included, from the viewpoint of improving shapeability at the time of manufacturing the structure and shape retainability at the time of casting, it is preferable that the content of the inorganic fiber is greater than 0 mass %, and preferably 20 mass % or less, more preferably 16 mass % or less, even more preferably 5 mass % or less, further preferably 3 mass % or less.

In cases where a plurality of types of inorganic fibers are included, the content of the inorganic fibers refers to the total amount.

The average fiber length and the average fiber diameter of the employed inorganic fibers may be within the aforementioned ranges, respectively.

In cases where carbon fiber is included as an inorganic fiber, from the viewpoint of improving shapeability at the time of manufacturing the structure and shape retainability at the time of casting, it is preferable that the content of the carbon fiber is preferably 1 mass % or greater, more preferably 2 mass % or greater.

Further, it is preferable that the content of the carbon fiber is preferably 20 mass % or less, more preferably 16 mass % or less.

From the viewpoint of improving the shapeability of the structure, the dough-like structure precursor may be supplied to and stretched by an external force application means, to be formed into a sheet shape (stretching step).

The external force application means is not particularly limited so long as the structure precursor can be stretched into a sheet shape, and for example, the structure precursor may be supplied between a pair of stretching rollers, or between a stretching roller and a flat plate, and stretched therebetween.

Before and after this step, the structure precursor is maintained in a state where it is easily deformable by external force.

Next, the dough-like or sheet-like structure precursor is heated and pressed in a pressing mold, and the structure precursor is dried and solidified and thereby shaped into a structure having the shape of the intended casting mold (shaping step). In this way, it is possible to obtain a structure having at least an organic fiber on the surface of the structure.

The pressing mold has a shape corresponding to the outer shape of the cast-article-manufacturing structure to be shaped. By heating and pressing the structure precursor with this pressing mold, the shape of the pressing mold is transferred onto the structure precursor, and the structure precursor is dried and solidified by removal of moisture contained therein, to thereby shape the structure precursor into a structure having the shape of the intended casting mold. Also, the thermosetting resin which may be contained as an organic component is cured.

The structure having undergone these steps becomes hard to deform by external force. The shaped structure may be formed such that a pair of segment dies is combined into a casting mold so as to have a cavity that opens toward the outside, or may be an integrally-molded structure.

The removal of moisture from the structure precursor by heating and pressurizing causes the layered clay mineral included in the precursor to lose molecules of the dispersion medium, such as water, existing between the unit crystal layers. By losing the molecules of the dispersion medium, the layered clay mineral shrinks and solidifies while forming a closely-packed structure inside the structure together with the organic fibers and the inorganic components such as the inorganic particles.

As a result, shear force is generated between the organic fibers, the layered clay mineral, and the other inorganic particles, thereby making the structure hard to deform by external force and effectively achieving the shape retainability of the structure.

It should be noted that, as regards the fiber length and fiber diameter of the organic fibers, the particle size of the various inorganic particles, and the fiber length and fiber diameter of inorganic fibers included as necessary, their fiber length, fiber diameter, and particle size are substantially unchanged even after undergoing mixing, swelling, drying, heating, and pressurizing performed through the course from the preparation of the structure precursor to the shaping step. Hence, the fiber length and fiber diameter of the various fibers and the particle size of the various particles which are used as raw materials are substantially the same as the fiber length and fiber diameter of the various fibers and the particle size of the various particles present in the structure.

From the viewpoint of facilitating the removal of the dispersion medium, such as water, from the structure precursor, it is preferable that the heating temperature in the shaping step is preferably 70° C. or higher, more preferably 100° C. or higher.

It is preferable that the heating temperature in the shaping step is preferably 250° C. or lower, more preferably 200° C. or lower.

From the viewpoint of manufacturing efficiency, it is preferable that the heating time in the shaping step is preferably 1 minute or more and preferably 60 minutes or less, on condition that the heating temperature is within the aforementioned range.

From the viewpoint of improving the shapeability of the structure, it is preferable that the pressure to be applied in the shaping step is preferably 0.5 MPa or greater, more preferably 1 MPa or greater.

From the viewpoint of improving the shapeability of the structure, it is preferable that the pressure is preferably 20 MPa or less, more preferably 10 MPa or less.

From the viewpoint of reducing gas defects in cast articles caused by steam due to the dispersion medium such as water, it is preferable that the moisture content of the cast-article-manufacturing structure is preferably 5 mass % or less, more preferably 3 mass % or less.

The moisture content of the cast-article-manufacturing structure may be adjusted in the aforementioned shaping step, or may be adjusted by performing a drying step in addition to the heating-pressing step.

In cases of performing the drying step, a known device, such as a temperature-controlled oven or a hot-air dryer, may be used.

The heating temperature and the heating time in the drying step may be the same as described above.

In cases of forming a casting mold by assembling cast-article-manufacturing structures consisting of a pair of segment dies, the intended casting mold can be manufactured by first producing structures as a pair of segment dies according to the aforementioned method, and then joining the segment dies such that the cavity side is on the interior.

As for methods of joining the segment dies, they may be joined, for example, by joining members, such as screws, clips, etc., or a general purpose adhesive, or may be joined using e.g., a sand mold for covering the pair of segment dies.

The thickness of the cast-article-manufacturing structure may be set as appropriate depending on the shape of the intended cast article. From the viewpoint of obtaining shape retainability and sufficient hot strength at the time of casting, it is preferable that the thickness at least in sections that come into contact with molten metal is preferably 0.2 mm or greater, more preferably 0.5 mm or greater, even more preferably 1 mm or greater.

From the viewpoint of improving the ease of handleability of the structure and reducing the amount of gas production, it is preferable that the thickness is preferably 10 mm or less, more preferably 5 mm or less.

The thickness of the structure can be adjusted by varying, as appropriate, the shape of the shaping mold and/or the pressure.

The cast-article-manufacturing structure manufactured through the aforementioned steps includes organic fibers. Thus, the structure has high toughness while being lightweight and has excellent handleability, and occurrence of disruption, cracking, fracture, etc., in the structure can be suppressed. Further, by including inorganic particles in the cast-article-manufacturing structure, it is possible to improve heat resistance while being lightweight and exhibiting a desired toughness, and the structure achieves both high shape retainability as well as high atmospheric temperature strength and hot strength.

Furthermore, it is possible to effectively reduce cast article defects, such as gas defects and burn-on of the structure onto the cast article's surface. As a result, it is possible to manufacture cast articles having excellent dimensional precision and surface smoothness.

Since cast articles with excellent dimensional precision and surface smoothness can be manufactured, it is possible to lessen post-treatments for providing the cast articles with a desired shape and dimensional precision; as a result, costs for manufacturing cast articles can be reduced.

As regards methods for manufacturing cast articles using the cast-article-manufacturing structure, a general casting method can be employed. More specifically, molten metal is poured in through a pouring gate formed in the cast-article-manufacturing structure, to perform casting. After the casting process is complete, the cast-article-manufacturing structure is cooled to a predetermined temperature and is removed, to expose the cast article. Then, if necessary, the cast article is subjected to post-treatment, such as trimming.

The present invention has been described above according to preferred embodiments thereof, but the present invention is not limited to the foregoing embodiments, and the various features can be employed in combination as appropriate.

EXAMPLES

The present invention will be described in further detail below by way of examples. The scope of the present invention is, however, not limited by the examples.

Example 1

As for the organic components, an organic fiber (mechanical pulp) and a thermosetting resin (phenolic resin; resol) were used. Mullite (spherical; average particle size: 30 μm) was used as first inorganic particles, and layered clay mineral particles (montmorillonite; Kunipia F from Kunimine Industries Co., Ltd.; average particle size: 145 μm) were used as second inorganic particles.

In addition, PAN-based carbon fiber (PYROFIL TR03CM A4G from Mitsubishi Chemical Corporation) was used as inorganic fiber.

These materials were mixed according to the proportions shown in Table 1 below, to prepare a structure precursor, and cast-article-manufacturing structures were manufactured according to the aforementioned method. As regards the shapes of the obtained cast-article-manufacturing structures, two types of structures were produced: a flat plate-shaped structure having a thickness of 2 mm; and a cylindrical structure having an outer diameter of 50 mm, length of 300 mm, and thickness of 2 mm. It should be noted that the flat plate-shaped cast-article-manufacturing structure was used to perform the later-described evaluations on the maximum bending stress, the bending strain at the maximum bending stress, the mass reduction rate, and the average fiber length and average fiber diameter on the structure surface; whereas the cylindrical cast-article-manufacturing structure was used to perform the later-described evaluations on the handleability of the structure, casting, and surface properties of the cast article's surface after casting.

The amount of water added was 50 parts by mass to 100 parts by mass of the mixture. The heating temperature and heating time of the structure precursor were 140° C. for 10 minutes, and the pressure in the shaping step was 5 MPa.

In the Table, "Total of Organic Components" refers to the contents of the organic components in the cast-article-manufacturing structure. In this Example, the structures were not subjected to treatment such as coating, and thus had no surface layer.

Example 2

As the organic fiber, a fiber including aramid resin (Kevlar (registered trademark) Cut Fiber from Toray Industries, Inc.; aramid resin: 100 mass %) was used instead of mechanical pulp, and no inorganic fiber was used. Other than the above, the materials were mixed according to the proportions shown in Table 1 below, and a cast-article-manufacturing structure was manufactured in the same manner as in Example 1.

Example 3

As the organic fiber, waste newspaper pulp, obtained by taking out pulp fiber from waste newspaper by beating in water, was used instead of mechanical pulp. Other than the above, the materials were mixed according to the proportions shown in Table 1 below, and a cast-article-manufacturing structure was manufactured in the same manner as in Example 1.

Example 4

As for the organic components, mechanical pulp as organic fiber and a thermosetting resin (phenolic resin; resol) were used. Obsidian (Nice Catch Flour #330 (polyhedric) from Kinsei Matec Co., Ltd.) having an average particle size of 27 μm was used as first inorganic particles. Obsidian contained aluminum oxide, silicon dioxide, and iron oxide.

In addition, PAN-based carbon fiber (PYROFIL TR03CM A4G from Mitsubishi Chemical Corporation) was used as inorganic fiber.

Other than the above, the materials were mixed according to the proportions shown in Table 1 below, and a cast-article-manufacturing structure was manufactured in the same manner as in Example 1.

Example 5

As the organic fiber, a fiber including polyester resin (fiber diameter: 11 μm; fiber length: 5 mm; polyester resin: 100 mass %) was used instead of mechanical pulp, and no inorganic fiber was used. Other than the above, the materials were mixed according to the proportions shown in Table 1 below, and a cast-article-manufacturing structure was manufactured in the same manner as in Example 1.

Example 6

As the organic fiber, a fiber including polyester resin (fiber diameter: 11 μm; fiber length: 5 mm; polyester resin: 100 mass %) was used instead of mechanical pulp. Other than the above, the materials were mixed according to the proportions shown in Table 1 below, and a cast-article-manufacturing structure was manufactured in the same manner as in Example 1.

Comparative Example 1

No organic fiber was used as the organic component. Other than the above, the materials were mixed according to the proportions shown in Table 1 below, and a cast-article-manufacturing structure was manufactured in the same manner as in Example 1.

Comparative Example 2

As the organic component, only waste newspaper pulp was used, instead of the combination of mechanical pulp and waste newspaper pulp. Other than the above, the materials were mixed according to the proportions shown in Table 1 below, and a cast-article-manufacturing structure was manufactured in the same manner as in Example 1.

Evaluation of Maximum Bending Stress and Bending Strain at Maximum Bending Stress:

For each cast-article-manufacturing structure of the respective Examples and Comparative Examples, a plate-shaped measurement sample was obtained according to the aforementioned method. The maximum bending stress (MPa) and the bending strain (%) at the maximum bending stress of each sample were measured in conformity with the three-point bending test of JIS K7017. The maximum bending stress and the bending strain are indices of the toughness of the cast-article-manufacturing structure; the higher the values of the maximum bending stress and the bending strain, the higher the toughness of the structure and the better the handleability of the structure. The results are shown in Table 1.

Evaluation of Mass Reduction Rate:

The mass reduction rate in each cast-article-manufacturing structure of the respective Examples and Comparative Examples was evaluated using a thermogravimetric instrument (STA7200RV TG/DTA from Seiko Instruments Inc.). Each cast-article-manufacturing structure of the respective Examples and Comparative Examples was heated under nitrogen atmosphere from 30° C. to 1000° C. at a temperature-rise rate of 20° C./minute, and the changes in mass were measured as a function of temperature. The mass reduction rate (%) was calculated, with reference to the mass at 30° C. The results are shown in Table 1.

Evaluation of Average Fiber Length and Average Fiber Diameter on Structure Surface:

The average fiber length and the average fiber diameter of the organic fibers present on the surface of each cast-article-manufacturing structure of the respective Examples and Comparative Examples were evaluated according to the aforementioned method. The results are shown in Table 1.

Evaluation of Number of Fibers on Structure Surface:

The number of organic fibers present on the surface of each cast-article-manufacturing structure of the respective Examples and Comparative Examples was evaluated according to the aforementioned method. The results are shown in Table 1.

Evaluation of Handleability of Structure:

The handleability of each cast-article-manufacturing structure of the respective Examples and Comparative Examples was evaluated according to the following method. Specifically, using a hand-held saw with rip teeth having a blade thickness of 1 mm, the structure was cut at a position 50 mm away from the structure's end face, and the length (mm) of the affected range, in which crazing, chipping, etc., occurred at the time of cutting, was measured from the cut end face. A shorter affected-range length indicates better handleability of the structure. The results are shown in Table 1 below.

Evaluation of Casting (Blowback Height):

Each cast-article-manufacturing structure of the respective Examples and Comparative Examples was used as a casting mold, and 25 kg of molten metal at 1350° C. and including cast iron was poured into the casting mold in 20 seconds, to manufacture a cast article. At this time, the blowback height (mm) of molten metal from the end face of the pouring gate, through which the molten metal was poured, was measured. A lower blowback height indicates that gas produced from the cast-article-manufacturing structure when pouring the molten metal can be suppressed, which means that gas defects in cast articles can be reduced and the safety during casting operation is improved. The results are shown in Table 1 below.

Evaluation of Surface Properties on Cast Article's Surface:

Each cast-article-manufacturing structure of the respective Examples and Comparative Examples was used as a casting mold, and molten metal at 1350° C. and including cast iron was poured into the casting mold, to manufacture a cast article. The area percentage of burn-on portions formed at this time was calculated, to evaluate the surface properties of the cast article's surface.

Specifically, on the cast article's surface in an area where the obtained cast article was in contact with the cast-article-manufacturing structure, portions where the poured molten metal has adhered by destroying the cast-article-manufacturing structure, as well as portions where sand inclusion originating from casting sand has adhered, were identified as burn-on portions, and the presence/absence of such burn-on portions and the regions thereof were determined by visual observation.

Next, for each region of burn-on portions determined according to the above method, a sheet material having a constant basis weight was cut so as to conform to the shape of each burn-on portion, and the sum total of the mass of the pieces cut out from the sheet material was divided by the basis weight of the sheet material, to calculate the area of the burn-on portions.

The cast article's surface area was found using a sheet material having a constant basis weight and covering the cast article's surface therewith such that the sheet material did not overlap, and the mass of the sheet material used for covering was divided by the basis weight of the sheet material, to calculate the cast article's surface area.

The area percentage of the burn-on portions was found by calculating the percentage (%) of the area of the burn-on portions with respect to the cast article's surface area.

A lower area percentage of the burn-on portions means that burn-on of the structure onto the cast article's surface can be reduced, thereby obtaining a cast article having excellent dimensional precision and surface smoothness. The results are shown in Table 1 below.

TABLE 1

| | | | Example 1 | Example 2 | Example 3 | Example 4 | Example 5 |
|---|---|---|---|---|---|---|---|
| Organic components | Organic fiber | Pulp fiber [mass %] | 0.5 | — | 5.0 | 0.5 | — |
| | | Fiber including aramid resin [mass %] | — | 3.0 | — | — | — |
| | | Fiber including polyester resin [mass %] | — | — | — | — | 3.0 |
| | | Average fiber length L1 [mm] | 1.6 | 1.5 | 2.0 | 1.8 | 1.1 |
| | | Average fiber diameter D1[μm] | 30 | 13 | 30 | 30 | 11 |
| | | Ratio: 1000 × L1 [mm]/D1[μm] | 53.3 | 115.4 | 66.7 | 60.0 | 100.0 |
| | Thermosetting resin | Phenolic resin [mass %] | 9.0 | 9.0 | 9.0 | 9.0 | 9.0 |
| | Total of organic components [mass %] | | 9.5 | 12.0 | 14.0 | 9.5 | 12.0 |
| Inorganic components | First inorganic particle | Mullite [mass %] | 72.5 | 73.0 | 68.0 | — | 73.0 |
| | | Obsidian [mass %] | — | — | — | 72.5 | — |
| | | Shape | Spherical | Spherical | Spherical | Polyhedric | Spherical |
| | | Melting point [° C.] | 1850 | 1850 | 1850 | 1340 | 1850 |

TABLE 1-continued

| | | | | | | |
|---|---|---|---|---|---|---|
| Second inorganic particle | Montmorillonite [mass %] | 15.0 | 15.0 | 15.0 | 15.0 | 15.0 |
| | Shape | Layered | Layered | Layered | Layered | Layered |
| Inorganic fiber | Carbon fiber [mass %] | 3.0 | — | 3.0 | 3.0 | — |
| | Average fiber length [mm] | 1.5 | — | 2.0 | 1.3 | — |
| | Average fiber diameter [μm] | 7 | — | 7 | 7 | — |
| Total of inorganic components [mass %] | | 90.5 | 88.0 | 86.0 | 90.5 | 85 |
| Total of components [mass %] | | 100 | 100 | 100 | 100 | 100 |
| Mass reduction amount [%] | | 5.78 | 8.01 | 9.69 | 6.53 | 8.57 |
| Number of organic fibers present per 100 $mm^2$ on surface of structure [pieces] | | 92 | 100 or more | 100 or more | 100 or more | 100 or more |
| JIS K7017: Three-point bending test | Maximum bending stress [MPa] | 16.11 | 11.79 | 9.23 | 14.45 | 12.83 |
| | Bending strain [%] at maximum bending stress | 1.15 | 1.69 | 1.24 | 1.03 | 1.75 |
| Evaluation of handicability of structure (affected-range length [mm]) | | 0.3 | 0.2 | 0.5 | 0.4 | 0.2 |
| Evaluation of casting (blowback height [mm]) | | 100 | 90 | 120 | 110 | 100 |
| Evaluation of surface properties on cast article's surface (area percentage of burn-on portions [%]) | | 1 | 1 | 2 | 2 | 1 |

| | | | Example 6 | Comparative Example 1 | Comparative Example 2 |
|---|---|---|---|---|---|
| Organic components | Organic fiber | Pulp fiber [mass %] | — | — | 26.0 |
| | | Fiber including aramid resin [mass %] | — | — | — |
| | | Fiber including polyester resin [mass %] | 2.0 | — | — |
| | | Average fiber length L1 [mm] | 1.2 | — | 2.0 |
| | | Average fiber diameter D1[μm] | 11 | — | 30 |
| | | Ratio: 1000 × L1 [mm]/D1[μm] | 109.1 | — | 66.7 |
| | Thermosetting resin | Phenolic resin [mass %] | 5.0 | 9.0 | 18.0 |
| | Total of organic components [mass %] | | 7.0 | 9.0 | 44.0 |
| Inorganic components | First inorganic particle | Mullite [mass %] | 75.0 | 73.0 | — |
| | | Obsidian [mass %] | — | — | 48.0 |
| | | Shape | Spherical | Spherical | Polyhedric |
| | | Melting point [° C.] | 1850 | 1850 | 1340 |
| | Second inorganic particle | Monmorillonite [mass %] | 15.0 | 15.0 | — |
| | | Shape | Layered | Layerext | — |
| | Inorganic fiber | Carbon fiber [mass %] | 3.0 | 3.0 | 8.0 |
| | | Average fiber length [mm] | 1.3 | 1.3 | 2.0 |
| | | Average fiber diameter [μm] | 7 | 7 | 7 |
| | Total of inorganic components [mass %] | | 93.0 | 93.0 | 56.0 |
| Total of components [mass %] | | | 100.0 | 100 | 100 |
| Mass reduction amount [%] | | | 5.32 | 5.54 | 29.37 |
| Number of organic fibers present per 100 $mm^2$ on surface of structure [pieces] | | | 100 or more | — | 100 or more |
| JIS K7017: Three-point bending test | | Maximum bending stress [MPa] | 18.20 | 21.30 | 11.92 |
| | | Bending strain [%] at maximum bending stress | 0.68 | 0.55 | 1.11 |
| Evaluation of handicability of structure (affected-range length [mm]) | | | 0.0 | 50 | 0.2 |
| Evaluation of casting (blowback height [mm]) | | | 70 | 110 | 730 |
| Evaluation of surface properties on cast article's surface (area percentage of burn-on portions [%]) | | | 1 | 1 | 5 |

As shown in Table 1, the cast-article-manufacturing structures of the Examples include predetermined amounts of organic components including organic fiber; thus, the maximum bending stress and the bending strain are equal to or higher than predetermined values, showing that the structures have improved toughness, and due thereto, the structures' handleability is improved, compared to the Comparative Examples. Further, since the cast-article-manufacturing structures of the Examples include predetermined amounts of organic components including organic fiber, the mass reduction rate of the structures is equal to or below a predetermined value, showing that gas defects in the obtained cast articles can be reduced efficiently. Furthermore, the area percentage of burn-on portions in the cast-article-manufacturing structures of the Examples is equivalent to or less than that of the Comparative Examples, which shows that burn-on of the structure onto the cast article's surface is reduced effectively, and cast articles having excellent dimensional precision and surface smoothness can be obtained.

Therefore, the cast-article-manufacturing structure of the present invention has excellent handleability and can reduce gas defects in the obtained cast articles and burn-on on the cast article's surface.

Particularly, the cast-article-manufacturing structures of Examples 1, 3 and 4, which contain inorganic fiber together with a small amount of organic fiber, are capable of improving bending stress while suppressing the amount of gas production.

Further, the cast-article-manufacturing structure of Example 5 is capable of significantly suppressing the cost of manufacturing the structure while sufficiently satisfying the bending properties with organic fiber only.

INDUSTRIAL APPLICABILITY

The present invention can provide a cast-article-manufacturing structure that has excellent handleability and with which it is possible to reduce gas defects in cast articles and burn-on on the cast article's surface.

The invention claimed is:

1. A structure for manufacturing a cast article, the structure comprising:

an organic component; and a plurality of inorganic particles on a surface of the structure, wherein:

at least a portion of the organic component is an organic fiber dispersed on the surface of the structure and in an interior of the structure, the structure has a mass reduction rate of greater than 5 mass % to less than 20 mass % when heated under nitrogen atmosphere at 1,000° C. for 30 minutes, the plurality of inorganic particles include a first inorganic particle which is not a layered particle, and a second inorganic particle which is a layered particle, the first inorganic particle has a first melting point of 1,200° C. or higher, and the second inorganic particle having a second melting point below 1,200° C., and the structure has a maximum bending stress of 9 MPa or greater measured in conformity with JIS K7017, and a bending strain of 0.6% or greater at the maximum bending stress.

2. The structure for manufacturing a cast article according to claim 1, wherein the first inorganic particle has the first melting point of 1,200° C. or higher and 2,500° C. or lower.

3. The structure for manufacturing a cast article according to claim 1, wherein the mass reduction rate is less than 15 mass %.

4. The structure for manufacturing a cast article according to claim 1, wherein the maximum bending stress is 9 MPa or greater and 50 MPa or less.

5. The structure for manufacturing a cast article according to claim 1, wherein the bending strain at the maximum bending stress is 0.65% or greater and 8% or less.

6. The structure for manufacturing a cast article according to claim 1, wherein each of the plurality of inorganic particles is one or two or more types selected from aluminum oxide, silicon dioxide, and iron oxide.

7. The structure for manufacturing a cast article according to claim 1, wherein each of the plurality of inorganic particles is one or more types selected from spherical particles and layered particles.

8. The structure for manufacturing a cast article according to claim 1, wherein 50 pieces or more and 300 pieces or fewer of the organic fiber are present per 100 $mm^2$ on the surface of the structure for manufacturing the cast article.

9. The structure for manufacturing a cast article according to claim 1, wherein the organic fiber on the surface of the structure for manufacturing the cast article has an average fiber length of 0.5 mm or greater and 7 mm or less, the organic fiber on the surface of the structure for manufacturing the cast article has an average fiber diameter of less than 40 μm and 8 μm or greater, a content of inorganic fiber included in the structure for manufacturing the cast article is from 0 to 20 mass %, and a content of the organic component in the structure for manufacturing the cast article is from 7.0 to less than 20 mass %.

10. The structure for manufacturing a cast article according to claim 9, wherein a ratio of an average fiber length of the organic fiber on the surface of the structure for manufacturing the cast article to the average fiber diameter of the organic fiber present on the surface is 10 or greater and 260 or less.

11. The structure for manufacturing a cast article according to claim 1, further comprising another organic component.

12. The structure for manufacturing a cast article according to claim 1, wherein the organic fiber includes one or plural selected from pulp fiber, fiber including polyester resin, and fiber including aramid resin.

13. The structure for manufacturing a cast article according to claim 1, wherein a content of inorganic fiber included in the structure for manufacturing the cast article is from 0 to 20 mass %.

14. The structure for manufacturing a cast article according to claim 1, wherein a content of the organic component in the structure for manufacturing the cast article is from 7.0 to less than 20 mass %.

15. The structure for manufacturing a cast article according to claim 14, wherein the content of the organic fiber in the structure for manufacturing the cast article is from 0.3 to 10 mass %.

16. The structure for manufacturing a cast article according to claim 1, wherein the structure for manufacturing the cast article has a thickness of 0.2 mm or greater and 10 mm or less.

17. The structure for manufacturing a cast article according to claim 1, wherein each of the plurality of inorganic particles is in the interior of the structure, the first inorganic particle and the second inorganic particle are different from one another in terms of predetermined shape and/or physical properties, the first inorganic particle is spherical, an average particle size of the first inorganic particle is 1 μm or greater and 1,000 μm or less, an average particle size of the second inorganic particle is 0.1 μm or greater and 500 μm or less, a ratio of an average fiber length of the organic fiber on the surface of the structure for manufacturing the cast article to an average fiber diameter of the organic fiber present on the surface is 10 or greater and 260 or less, the maximum bending stress is 9 MPa or greater and 50 MPa or less, and the bending strain at the maximum bending stress is 0.65% or greater and 8% or less.

18. A method comprising:

providing a structure for manufacturing a cast article, the structure including:

an organic component; and a plurality of inorganic particles on a surface of the structure, wherein:

at least a portion of the organic component is an organic fiber dispersed on the surface of the structure and in an interior of the structure;

the structure has a mass reduction rate of greater than 5 mass % to less than 20 mass % when heated under nitrogen atmosphere at 1,000° C. for 30 minutes;

the plurality of inorganic particles include a first inorganic particle which is not a layered particle, and a second inorganic particle which is a layered particle;

the first inorganic particle has a first melting point of 1,200° C. or higher, and the second inorganic particle having a second melting point below 1,200° C.; and the structure has a maximum bending stress of 9 MPa or greater measured in conformity with JIS K7017, and a bending strain of 0.6% of greater at the maximum bending stress.

19. The method according to claim 18, further comprising manufacturing the cast article using the structure for manufacturing the cast article.

* * * * *